US011718092B2

(12) United States Patent
Komamiya et al.

(10) Patent No.: US 11,718,092 B2
(45) Date of Patent: Aug. 8, 2023

(54) RECORDING APPARATUS

(71) Applicant: CANON KABUSHIKI KAISHA, Tokyo (JP)

(72) Inventors: Yumi Komamiya, Kanagawa (JP); Takaya Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/525,668

(22) Filed: Nov. 12, 2021

(65) Prior Publication Data

US 2022/0161552 A1 May 26, 2022

(30) Foreign Application Priority Data

Nov. 26, 2020 (JP) ..... 2020-196421

(51) Int. Cl.
*B41J 2/14* (2006.01)
*B41J 2/045* (2006.01)

(52) U.S. Cl.
CPC ..... *B41J 2/0458* (2013.01); *B41J 2/1408* (2013.01)

(58) Field of Classification Search
CPC ..... B41J 2/14; B41J 2/315; B41J 2/18; B41J 2202/12; B41J 2/1408; B41J 2/1404; B41J 2/01
See application file for complete search history.

(56) References Cited

U.S. PATENT DOCUMENTS

| | | | | |
|---|---|---|---|---|
| 5,191,357 | A | 3/1993 | Ono | |
| 2005/0212871 | A1* | 9/2005 | Kadomatsu | B41J 11/0021 347/76 |
| 2012/0182337 | A1* | 7/2012 | Nishi | B41J 29/393 347/9 |

FOREIGN PATENT DOCUMENTS

| | | | | |
|---|---|---|---|---|
| CN | 105209261 | A | 12/2015 | |
| CN | 105365397 | A | 3/2016 | |
| CN | 107053849 | A | 8/2017 | |
| CN | 107081960 | A | 8/2017 | |
| CN | 107433774 | A | 12/2017 | |
| CN | 111483229 | A | 8/2020 | |
| CN | 111716910 | A | 9/2020 | |
| EP | 0409243 | A2 | 1/1991 | |
| JP | 2017213871 | A | 12/2017 | |
| JP | 2019014172 | * | 1/2019 | B41J 2/14024 |

* cited by examiner

*Primary Examiner* — Kristal Feggins
(74) *Attorney, Agent, or Firm* — Canon U.S.A., Inc. I.P. Division

(57) ABSTRACT

A recording apparatus that performs recording on a recording medium, includes a liquid discharge head including a plurality of element substrates each having a discharge port configured to discharge liquid and a heat element configured to heat the liquid, a channel member including a common supply channel configured to communicate with the plurality of the element substrates and to supply the liquid to the plurality of the element substrates, and a common collecting channel configured to communicate with the plurality of the element substrates and to collect the liquid from the plurality of the element substrates, wherein the common supply channel and the common collecting channel are respectively disposed out of alignment in a conveyance direction of the recording medium, and wherein, upstream of the element substrates, the recording apparatus comprises a heat unit configured to heat the liquid flowing in the common supply channel.

16 Claims, 8 Drawing Sheets

60
211(212)
212(211)
RECORDING MEDIUM CONVEYANCE DIRECTION
DIRECTION VIEWED FROM SIDE WHERE DISCHARGE PORT OPENS
LIQUID DISCHARGE DIRECTION

RECORDING APPARATUS

BACKGROUND

Field of the Disclosure

The present disclosure relates to a recording apparatus.

Description of the Related Art

A liquid discharge apparatus (recording apparatus) that discharges liquid onto a recording medium such as paper, includes an ink jet printer. The ink jet printer is provided with a liquid discharge head, which is a part that ejects liquid. The liquid discharge head is provided with, for example, a discharge port for discharging the liquid, a pressure generation element for generating a pressure for discharging liquid from the discharge port, a pressure chamber in which the pressure generated by the pressure generation element acts on.

When performing the operation of discharging liquid from the discharge port, it is desirable that the viscosity of the liquid is within a desired range, and if the viscosity of the liquid is outside the desired range, the discharge performance may be reduced.

Japanese Patent Application Laid-Open No. 2017-213871 discusses a liquid discharge head in which a heat element to control the viscosity of liquid by heating the liquid is provided in the vicinity of a pressure chamber. This liquid discharge head adjusts the temperature of the liquid to control the viscosity by driving the heat element to heat the liquid to such an extent as not to cause foaming. Further, the liquid discharge head discussed in Japanese Patent Application Laid-Open No. 2017-213871 has a channel configuration in which, in order to suppress an increase in viscosity of the liquid caused by the liquid evaporation from the discharge port, a collecting channel for collecting the liquid from the pressure chamber is provided, and the liquid can be circulated upstream and downstream of the pressure chamber.

As discussed in Japanese Patent Application Laid-Open No. 2017-213871, when the heat element for controlling the viscosity of the liquid is provided in the vicinity of the pressure chamber, the liquid heated by the heat element flows through the collecting channel, which is a channel downstream of the pressure chamber. Accordingly, the temperature of the liquid flowing through the collecting channel is higher than the temperature of the liquid flowing through a supply channel, which is a channel upstream of the pressure chamber and is for supplying the liquid to the pressure chamber. As a result, in a channel member having the collecting channel and the supply channel, the temperature around the collecting channel becomes higher than the temperature around the supply channel, thus causing a temperature bias (temperature gradient) in the channel member.

Even if no heat element for controlling the viscosity of the liquid is provided, such a temperature gradient is similarly generated when a heat element for film-boiling the liquid is, as a pressure generation element, provided in the pressure chamber. Thus, when the collecting channel and the supply channel are arranged side by side in the conveyance direction of the recording medium, the temperature gradient in the channel member may deform the channel member in the conveyance direction of the recording medium, which may affect recording quality.

SUMMARY

Aspects of the present disclosure include a recording apparatus capable of suppressing deformation of a channel member in a conveyance direction of a recording medium.

According to an aspect of the present disclosure, a recording apparatus that performs recording on a recording medium, includes a liquid discharge head including a plurality of element substrates each having a discharge port configured to discharge liquid and a heat element configured to heat the liquid, a channel member including a common supply channel configured to communicate with the plurality of the element substrates and to supply the liquid to the plurality of the element substrates, and a common collecting channel configured to communicate with the plurality of the element substrates and to collect the liquid from the plurality of the element substrates, wherein the common supply channel and the common collecting channel are respectively formed disposed out of alignment in a conveyance direction of the recording medium, and upstream of the element substrates, the recording apparatus comprises a heat unit configured to heat the liquid flowing in the common supply channel.

Further features of the present disclosure will become apparent from the following description of exemplary embodiments with reference to the attached drawings.

DESCRIPTION OF THE EMBODIMENTS

Hereinafter, exemplary embodiments of the present disclosure will be described with reference to the attached drawings. The deformation of a channel member tends to be larger as the channel member is longer. Thus, the present disclosure is particularly preferable for use in a so-called page-wide type head corresponding to a recording width of a recording medium such as paper, which has a channel member longer than a channel member of a so-called serial type liquid discharge head. The page-wide type head is referred to as a head in which a plurality of discharge ports is arranged from one end of the recording medium to the other end of the recording medium in a direction intersecting a conveyance direction of the recording medium. Hereinafter, the explanation will be given using the page-wide head as an example.

Further, in each of exemplary embodiments, a configuration in which liquid circulates inside and outside of the liquid discharge head is used as an example for the description, but the present disclosure is not limited thereto. More specifically, the present disclosure can be preferably used in a configuration in which liquid does not circulate inside and outside of the liquid discharge head.

<Recording Apparatus>

Figure 1:
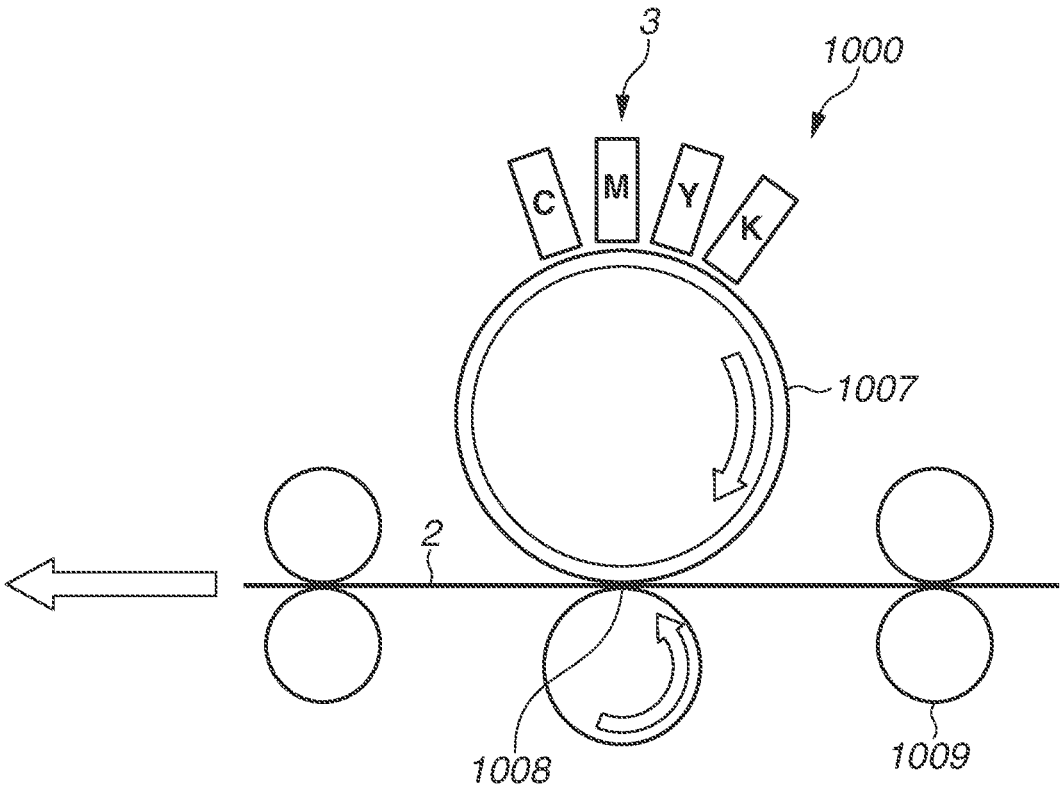
FIG. 1 is a schematic view of a recording apparatus.

A recording apparatus will be described with reference to FIG. 1. FIG. 1 is a schematic diagram illustrating an example of a recording apparatus 1000 provided with a liquid discharge head 3. The recording apparatus 1000 illustrated in FIG. 1 discharges liquid from the liquid discharge head 3 onto an intermediate transfer member (intermediate transfer drum) 1007 to form an image pattern (print pattern) on the intermediate transfer member 1007, and then transfers the image pattern to a recording medium 2. In the recording apparatus 1000, four single color liquid discharge heads 3, respectively corresponding to at least four types of CMYK inks, are arranged on an arc-shape along the intermediate transfer member 1007. With this configuration, full color recording is performed on the intermediate transfer member 1007, and the recorded image pattern thereof is properly dried on the intermediate transfer member 1007. Then, the recorded image pattern is transferred by the transfer roller 1008 to the recording medium 2 from the intermediate transfer member 1007. At this time, the transfer is performed while the recording medium 2 is conveyed by a paper conveyance roller 1009.

Although the recording apparatus 1000 illustrated in FIG. 1 is a recording apparatus that performs recording by using the intermediate transfer member 1007, the recording apparatus provided with the liquid discharge head of the present disclosure is not limited thereto. In other words, the recording apparatus may be a recording apparatus that performs recording by directly discharging the liquid from the liquid discharge head 3 onto the recording medium 2 without using the intermediate transfer member 1007.

<Path of Liquid>

Figure 2:
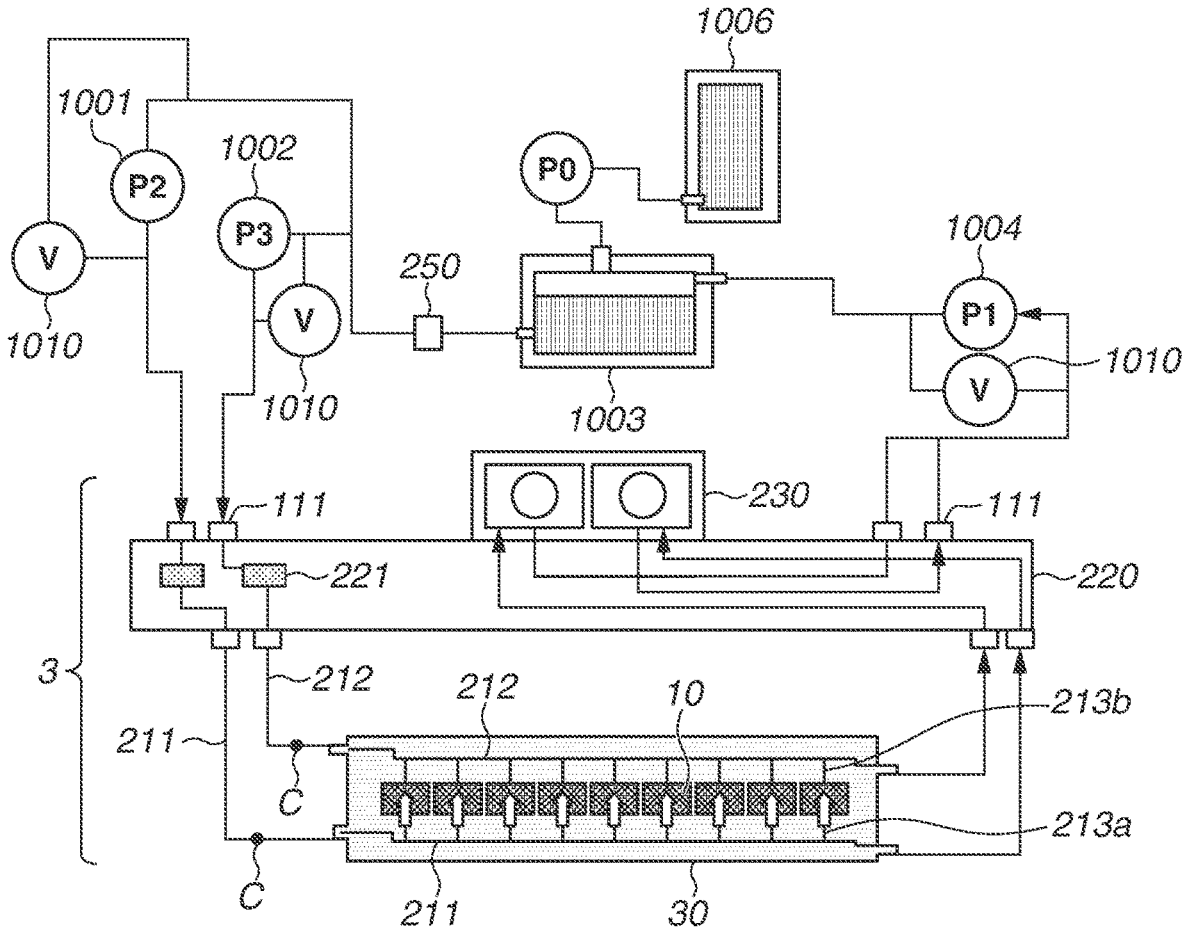
FIG. 2 is a schematic view illustrating a liquid flow path of the recording apparatus.

The path of the liquid will be described with reference to FIG. 2. FIG. 2 is a schematic diagram illustrating a flow path of a liquid in the recording apparatus 1000. Two pressure adjustment mechanisms that configure a negative pressure control unit 230 are mechanisms (mechanical components that operate in the same way as a so-called "back pressure regulator") that control the pressure fluctuation upstream of the negative pressure control unit 230 so as to be contained within a certain range around a desired set pressure. Thus, even if the flow rate of liquid fluctuates due to change in the record duty when the recording is performed by the liquid discharge head 3, the two pressure adjustment mechanisms operate so as to stabilize the pressure fluctuation on the upstream side (liquid discharge unit 300 side) within a certain range around a preset pressure. A second circulation pump 1004 operates as a negative pressure source to reduce the pressure downstream of the negative pressure control unit 230. A first circulation pump (high pressure side) 1001 and a first circulation pump (low pressure side) 1002 are arranged upstream of the liquid discharge head 3, and the negative pressure control unit 230 is arranged in the liquid discharge head 3.

It is preferable to pressurize, by the second circulation pump 1004, the downstream side of the negative pressure control unit 230 via a liquid supply unit 220. In this way, the influence of a water head pressure of a buffer tank 1003 with respect to the liquid discharge head 3 can be suppressed, and the range of selection of the layout of the buffer tank 1003 in the recording apparatus 1000 can be expanded. The buffer tank 1003 is a tank for storing the liquid to be supplied to the liquid discharge head 3. Instead of the second circulation pump 1004, for example, a water head tank arranged with a predetermined water head difference relative to the negative pressure control unit 230 is also applicable.

The negative pressure control unit 230 is provided with the two pressure adjustment mechanisms with control pressures different from each other being set. Of the two negative pressure adjustment mechanisms, a high pressure setting side (described as H in FIG. 4B) and a low pressure side (described as L in FIG. 4B) are respectively connected to a common supply channel 211 and a common collecting channel 212 in the liquid discharge unit 300 through the liquid supply unit 220. Making the pressure of the common supply channel 211 relatively higher than the pressure of the common collecting channel 212 by the two negative pressure adjustment mechanisms causes an ink flow (in the arrow direction) from the common supply channel 211 to the common collecting channel 212 through an individual supply channel 213*a* and through an internal channel of each element substrate 10. In other words, the liquid collected by the common collecting channel 212 circulates outside the element substrate 10 and flows to the common supply channel 211.

Since the negative pressure control unit 230 is arranged on the downstream side of the liquid discharge head 3, there is little possibility that dusts or foreign matters generated from the negative pressure control unit 230 may flow into the head. In addition, the maximum required flow rate supplied from the buffer tank 1003 to the liquid discharge head 3 can be reduced. The reasons therefor are as follows. The sum of the flow amounts in the common supply channel 211 and the common collecting channel 212 in the case of circulation in the recording standby state is defined as A. The value A is defined as the minimum flow rate required to keep the temperature difference in the liquid discharge unit 300 within a desired range when the temperature of the liquid discharge head 3 is adjusted in the recording standby state. The discharge flow rate of when the ink is discharged from all discharge ports (not illustrated) of the liquid discharge unit 300 (at full discharge) is defined as F. Then, the liquid supply amount, which is supplied to the liquid discharge head 3 required in the recording standby state, is the flow rate A. Then, the supply amount to the liquid discharge head 3 required at the time of full discharge is the flow rate F. Then, the total value of the set flow rates of the first circulation pump (high pressure side) 1001 and the first circulation pump (low pressure side) 1002, i.e., the maximum value of the required supply flow rate will be the larger one of A and F. Thus, as long as the liquid discharge unit 300 with the same configuration is used, the maximum value of the required supply flow rate (A or F) will be small. Thus, the freedom degree of the applicable circulating pump is increased, and for example, a low-cost circulating pump with a simple configuration can be used or the load on a cooler (not illustrated) installed in the main body side flow path can be reduced, thus bringing about an advantage of reducing the cost of the main body of the recording apparatus. This advantage is greater for a line head where the value of A or F is relatively large, and is more beneficial for a line head with a longer longitudinal length.

The first function can suppress an excessive high pressure or an excessive low pressure from being applied to the channel downstream of the first circulation pumps 1001 and 1002 or upstream of the second circulation pump 1004. For example, if the functions of the first circulation pumps 1001 and 1002 have any trouble, an excessive flow rate or pressure may be applied to the liquid discharge head 3. This may cause a leakage of liquid from a discharge port 13 of the liquid discharge head 3 or a breakage of each joint portion in the liquid discharge head 3. However, if a bypass valve is added for the first circulation pumps 1001 and 1002, even if the excessive pressure is caused, a bypass valve 1010 opens to open the liquid route to the upstream side of each circulation pump, thus making it possible to suppress the above trouble.

Further, by the second function, when the circulation drive is stopped, all the bypass valves 1010 are promptly opened based on a control signal from the main body after the first circulation pumps 1001, 1002 and the second circulation pump 1004 stop. This enables the high negative pressure (e.g., several to several tens of kPa) in the downstream portion of the liquid discharge head 3 (between the negative pressure control unit 230 and the second circulation pump 1004) to be released in a short time. When a positive displacement pump such as a diaphragm pump is used as a circulation pump, a check valve is usually built in the pump. However, opening the bypass valve 1010 can perform the pressure release of the downstream portion of the liquid discharge head 3 from the downstream buffer tank 1003 side as well. Although, from the upstream side alone, the pressure release can be performed in the downstream portion of the liquid discharge head 3, there is a pressure loss in the upstream channel of the liquid discharge head 3 and the channel in the liquid discharge head 3. Thus, it takes time to release the pressure, and the pressure in the common channel in the liquid discharge head 3 transiently drops too much, which may destroy the meniscus of the discharge port 13. Opening the bypass valve 1010 on the downstream side of the liquid discharge head 3 promotes the pressure release on the downstream side of the liquid discharge head 3, thereby reducing the risk of meniscus destruction at the discharge port 13.

In FIG. 2, the recording apparatus 1000 in a configuration in which liquid such as ink is circulated between a main tank 1006 and the liquid discharge head 3 is described, but the present disclosure is not limited thereto. For example, the recording apparatus 1000 may have such a configuration in which tanks are provided on the upstream side and the downstream side of the liquid discharge head 3, respectively, without circulating the ink, and the ink is caused to flow from one tank to another tank.

A heat unit 250 is arranged upstream of the element substrate 10 (upstream of the common supply channel 211). As will be described in detail below, the heat unit 250 is arranged to raise the temperature of the liquid flowing in the common supply channel 211, thus making it possible to suppress a channel member 210 illustrated in FIGS. 3A and 3B from being deformed in a conveyance direction of the recording medium 2.

<Liquid Discharge Head>

Figure 3A:
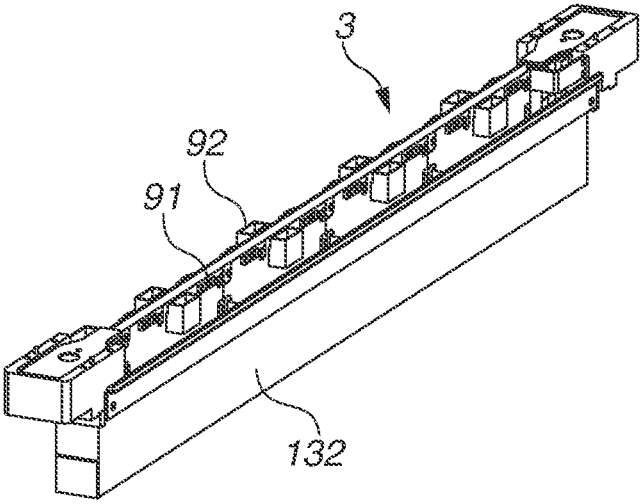
FIGS. 3A and 3B are perspective views of a liquid discharge head.
Figure 3B:
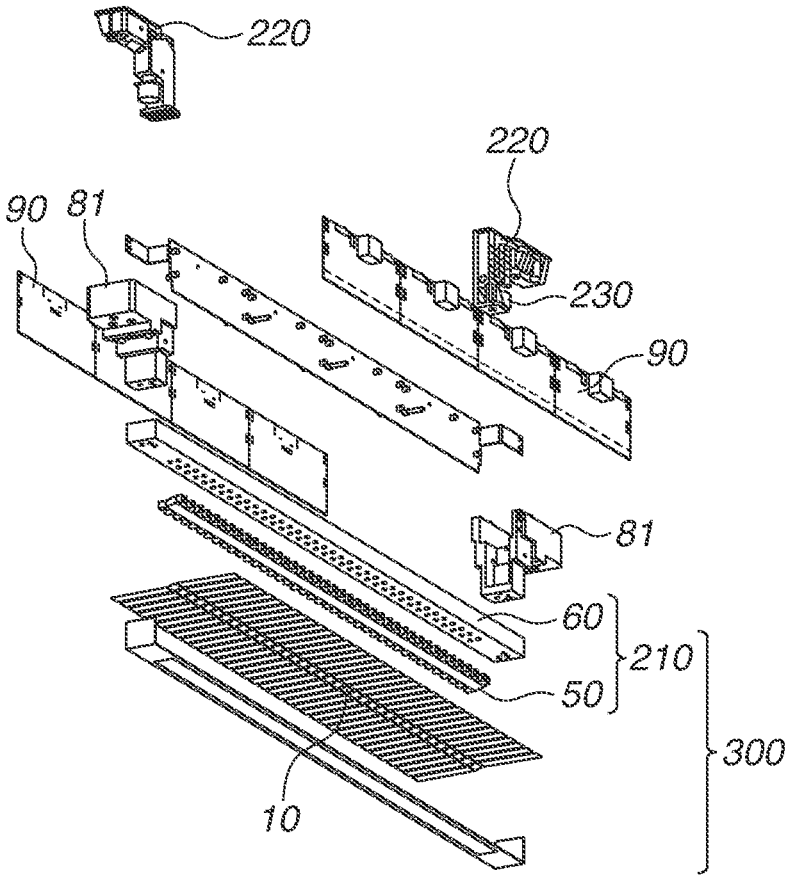
Figure 4A:
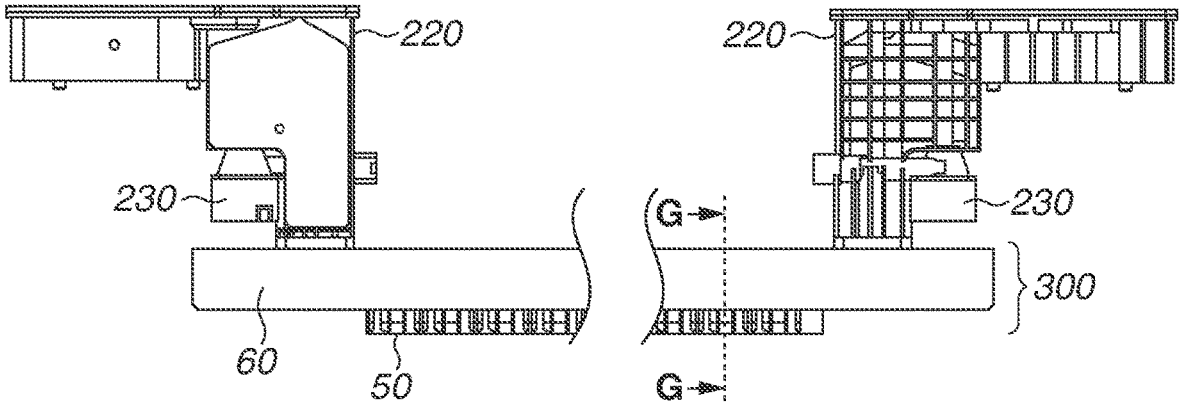
FIGS. 4A and 4B are side views of the liquid discharge head.
Figure 4B:
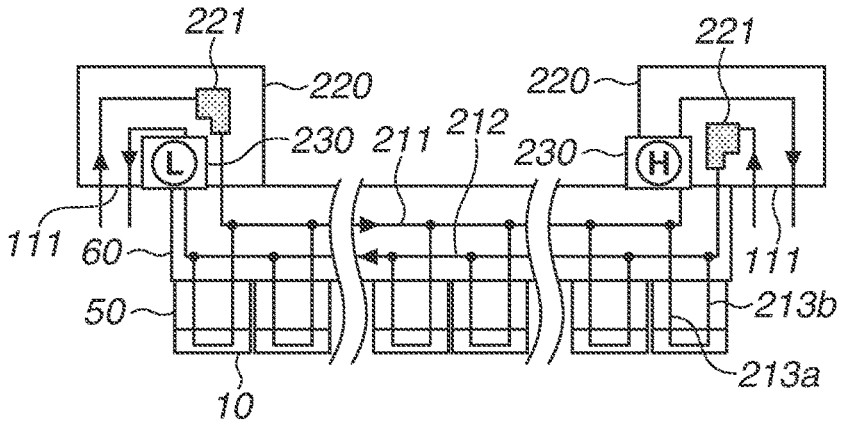

The liquid discharge head 3 will be described with reference to FIGS. 3A to 5B. FIG. 3A is a perspective view of the liquid discharge head 3. FIG. 3B is an exploded perspective view of the liquid discharge head 3 (shield plate 132 is not illustrated). FIG. 4A is a side view of the liquid discharge head 3. FIG. 4B is a schematic diagram illustrating the flow of liquid inside the liquid discharge head 3. The flow of circulation of the liquid illustrated in FIG. 4B is the same in a circulation route as the flow path of circulation illustrated in FIG. 2, but in FIG. 4B, the flow of the liquid in each component of the actual liquid discharge head 3 is illustrated. For ease of understanding, some configurations have been simplified.

The liquid discharge head 3 has an element substrate 10 for discharging the liquid from a discharge port 13, and a channel member 210 having a channel that supplies and collects liquid to the element substrate 10. The liquid discharge head 3 is a so-called page-wide type head provided with thirty six element substrates 10 that are arranged in a linear (in-line) manner in the longitudinal direction of the liquid discharge head 3. A pressure generation elements 5 (FIG. 5B) each generating a pressure for discharging the liquid from a discharge port 13 and a heat element 15 each heating the liquid so as to adjust the temperature of the liquid in a pressure chamber 7, are formed on the element substrate 10. The heat element 15 heats the liquid in the pressure chamber 7 thereby to adjust the viscosity to an appropriate level for discharging. The liquid discharge head 3 has a signal input terminal 91 for receiving a signal from outside the liquid discharge head 3, a power supply terminal 92 for receiving electric power, and the shield plate 132 for protecting a side surface of the liquid discharge head 3.

The liquid discharge head 3 secures rigidity of the liquid discharge head 3 by the second channel member 60 configuring the channel member 210. A liquid discharge unit support portion 81 is connected to each of both end portions of the second channel member 60, and the liquid discharge unit 300 is mechanically coupled to a carriage of the recording apparatus 1000 to position the liquid discharge head 3. The liquid supply unit 220 provided with the negative pressure control unit 230 and an electrical wiring substrate 90 are coupled to the liquid discharge unit support portion 81. A filter (not illustrated) is built in each of the two liquid supply units 220. The two negative pressure control units 230 are set to control a pressure at negative pressures, which are different from each other, of relatively high and low.

Next, details of the channel member 210 of the liquid discharge unit 300 will be described. The channel member 210 is obtained by laminating a first channel member 50 and a second channel member 60, and distributes, to each of discharge modules 200, the liquid supplied from the liquid supply unit 220. The channel member 210 also functions as a channel member for returning, to the liquid supply unit 220, the liquid recirculated from the discharge module 200. The second channel member 60 of the channel member 210 is a channel member in which the common supply channel 211 and the common collecting channel 212 are formed inside, and also has a function of being mainly responsible for the rigidity of the liquid discharge head 3. For this reason, a material having a sufficient corrosion resistance to the liquid and high mechanical strength is preferred for the second channel member 60. Specifically, stainless steel (SUS), titanium (Ti), alumina, and the like can be preferably used.

The first channel member 50 is composed of a plurality of members corresponding to respective element substrates 10 and arranged adjacent to each other. With such a configuration, a plurality of element substrates 10 can be arranged in the first channel member 50, and the length of the liquid discharge head 3 can be made to match the width of the recording medium 2. For example, the above-described configuration is particularly preferable for a relatively long-scale liquid discharge head 3 that can deal with B2 size and longer. The individual supply channels 213*a* and an individual collecting channels 213*b* of the first channel member 50 are in fluid communication with the element substrate 10.

The element substrate 10 is formed with a channel connected to each of the discharge ports 13, so that some or all of the supplied liquid can pass through the discharge ports 13 with which the discharge operation is suspended, and can recirculate. Via the liquid supply unit 220, the common supply channel 211 is connected to the negative pressure control unit 230 (high pressure side) and the common collecting channel 212 is connected to the negative pressure control unit 230 (low pressure side). Accordingly, the differential pressure thereof causes the ink to flow from the common supply channel 211 through the discharge port 13 of the element substrate 10 to the common collecting channel 212. In other words, the ink flows from the common supply channel 211 on the upstream side to the common collecting channel 212 on the downstream side through the element substrate 10. After the liquid is discharged from the element substrate 10, the liquid may temporarily flow into the element substrate 10 also from the common collecting channel 212, but this is not considered to be an upstream/downstream relationship with respect to the flow of the liquid in the present disclosure.

A set of the common supply channels 211 and common collecting channels 212, which extend in the longitudinal direction of the liquid discharge head 3, is provided in the long second channel member 60. The flow direction of the liquid flowing through the common supply channel 211 and the flow direction of the liquid flowing through the common collecting channel 212 are opposite to each other, and filters 221 are provided on the upstream side of the respective channels 211, 212 thereby to collect foreign matter that enters from a liquid connection portion 111 or the like. Flowing the liquid in the common supply channel 211 and the common collecting channel 212 in directions opposite to each other promotes the heat exchange between the common supply channel 211 and the common collecting channel 212, which is preferable in that the temperature gradient in the longitudinal direction in the liquid discharge head 3 is reduced. In FIG. 2, the flow of the common supply channel 211 and the flow of the common collecting channel 212 are illustrated in the same direction for simplification of explanation.

The negative pressure control unit 230 is connected to the downstream side of each of the common supply channel 211 and the common collecting channel 212. In the middle of the common supply channel 211, there is a branch portion to each of a plurality of supply channels 213*a*, and in the middle of the common collecting channel 212, there is a branch portion to each of a plurality of collecting channels 213*b*. The individual supply channel 213*a* and the individual collecting channel 213*b* are formed in the plurality of first channel members 50.

The negative pressure control unit 230, illustrated in FIG. 4B as H and L, is a unit of a high pressure side (H) and a low pressure side (L). The respective negative pressure control units 230 are a back pressure type pressure adjustment mechanism set so as to control the pressure of upstream side of the negative pressure control unit 230 at relatively high (H) and low (L) negative pressures. The common supply channel 211 is connected to the negative pressure control unit 230 (H) and the common collecting channel 212 is connected to the negative pressure control unit 230 (L), thereby causing a differential pressure between the common supply channel 211 and the common collecting channel 212. The differential pressure causes the liquid to flow from the common supply channel 211 through the individual supply channel 213*a*, the element substrate 10, and the individual collecting channel 213*b* in this order to the common collecting channel 212.

Figure 5A:
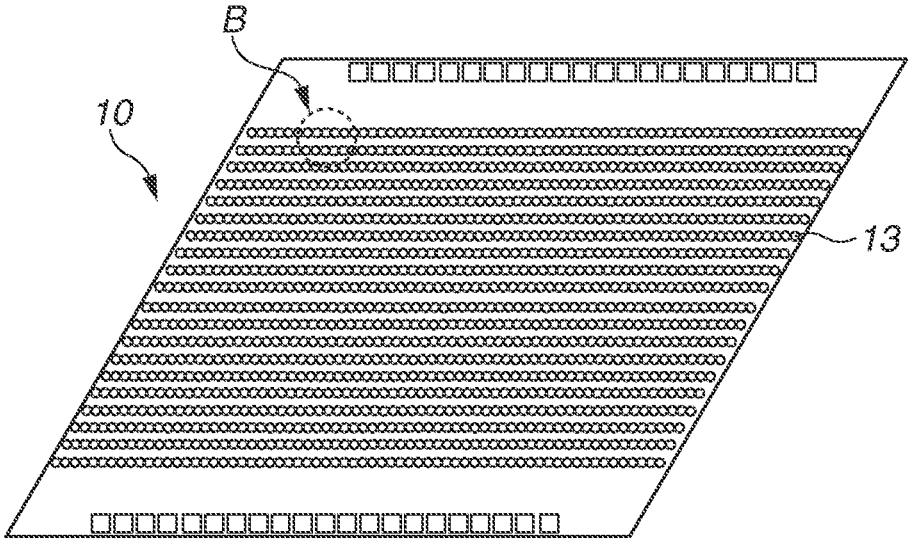
FIGS. 5A and 5B are top views of an element substrate.
Figure 5B:
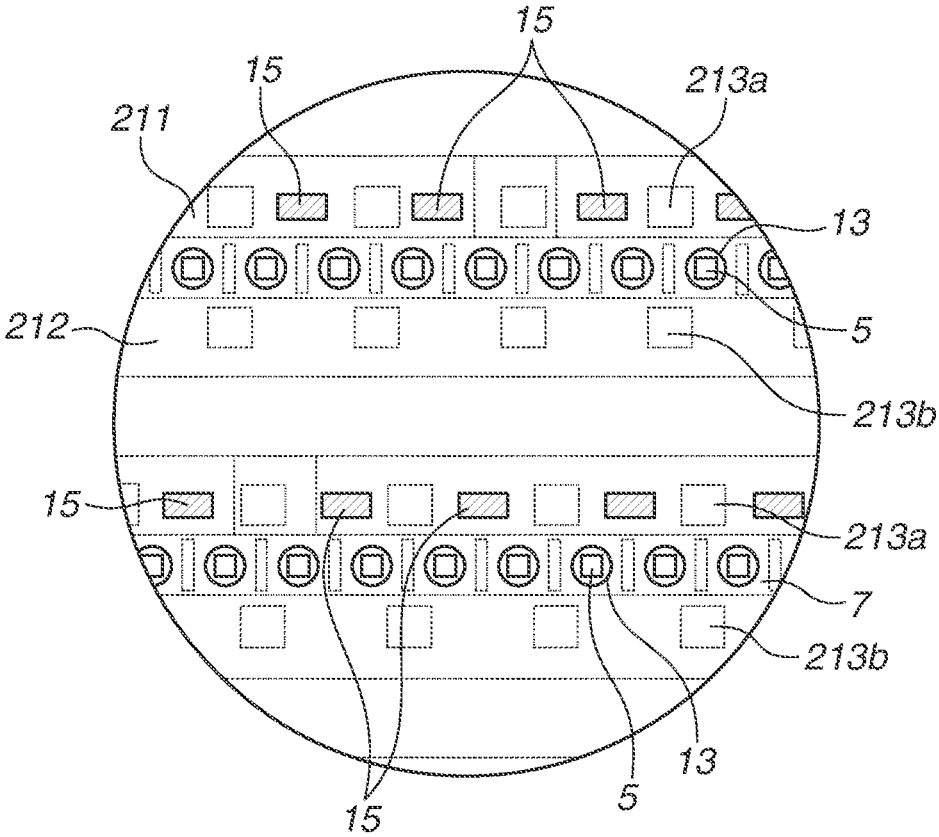

FIG. 5A is a top view of the element substrate 10. FIG. 5B is an enlarged view of a part B illustrated in FIG. 5A. Liquid is supplied through the individual supply channel 213*a* to the discharge port 13. A heat element (hereinafter referred to as a main heater 5) as the pressure generation element 5 is formed directly below the discharge port 13. Driving main heater 5 film-boils the liquid, thereby to obtain a pressure for discharging the liquid from the discharge port 13. In the vicinity of the discharge port 13, the heat elements 15 (hereinafter referred to as sub-heater 15), which heat the liquid so as to control the viscosity of the liquid, are formed along the arranging direction of the discharge ports 13. Driving the sub-heater 15 heats the liquid and can control the viscosity of the liquid.

Figure 6A:
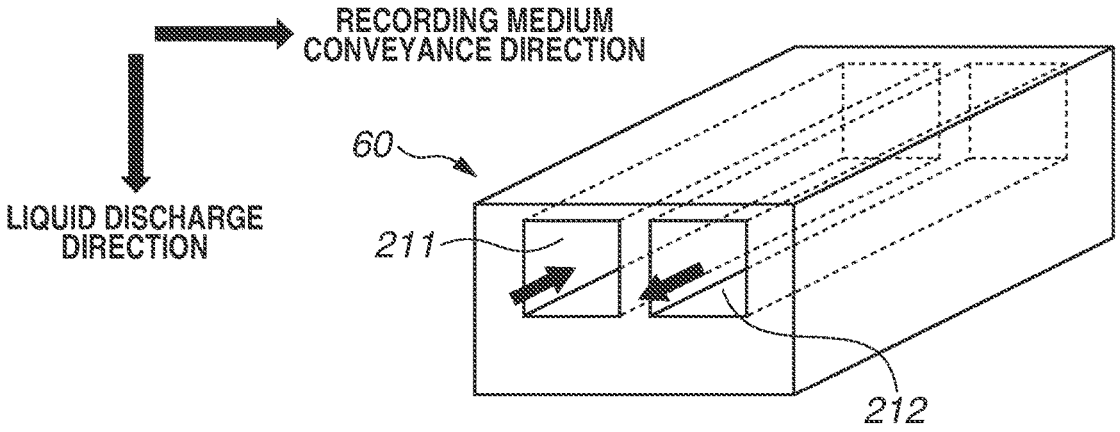
FIGS. 6A and 6B are schematic views illustrating internal structures of a channel member in a comparative example.
Figure 6B:
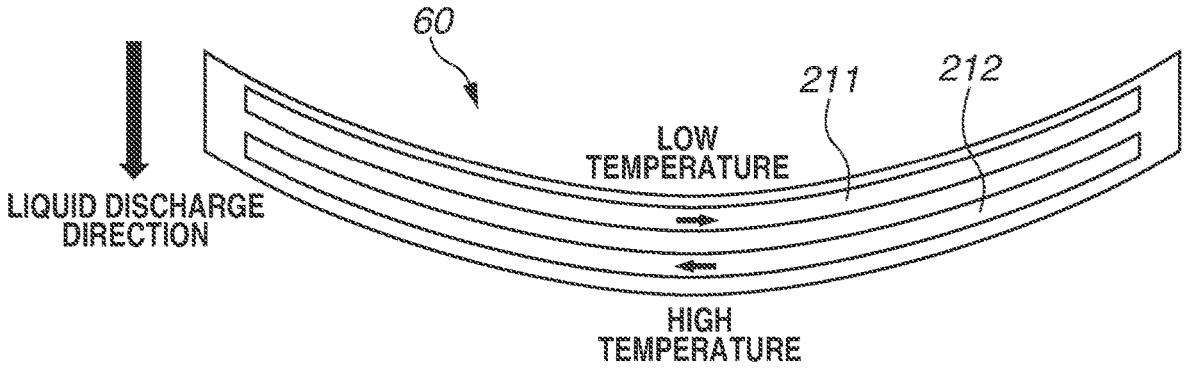
Figures 7A, 7B, 7C, 7D, 7E:
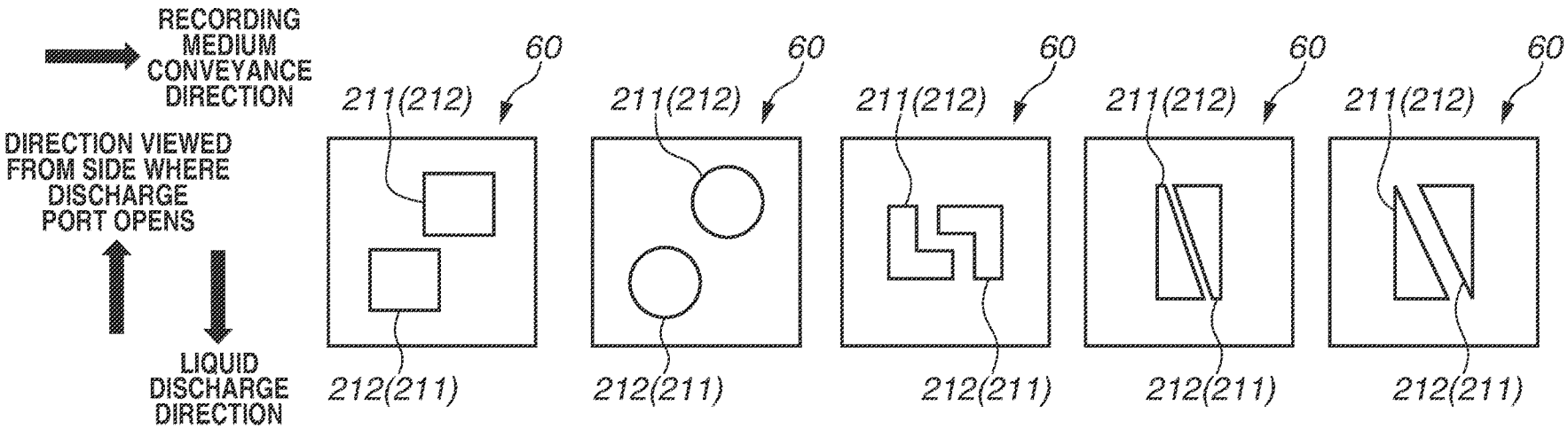
FIGS. 7A to 7E are schematic views illustrating cross-sections of the channel member according to a third exemplary embodiment.

A first exemplary embodiment of the present disclosure will be described with reference to FIG. 2 and FIGS. 6A and 6B. FIG. 6A is a schematic view illustrating the internal structure of the channel member in a comparative example of the present exemplary embodiment, and is a cross-sectional view taken along the line G-G of FIG. 4A. FIG. 6B is a top view of the second channel member 60 illustrated in FIG. 6A, viewed from the +Z direction, illustrating the internal structure so that the internal channels can be seen. FIGS. 6A and 6B are illustrated in a simplified manner for the sake of explanation.

As described above, in the liquid discharge head 3 according to the present exemplary embodiment, the common supply channel 211 and the common collecting channel 212 extend in the second channel member 60 across the longitudinal direction. In other words, the common supply channel 211 and the common collecting channel 212 are formed along the longitudinal direction of the channel member. The liquid heated to a predetermined temperature by the heat element flows into the common collecting channel 212 via the individual collecting channels 213*b*. As a result, the liquid temperature in the common collecting channel 212 becomes higher than the liquid temperature in the common supply channel 211, and the second channel member 60 becomes relatively hotter on the common collecting channel 212 side and relatively cooler on the common supply channel 211 side. As illustrated in FIG. 6B, this temperature gradient causes the common collecting channel 212 side to thermally expand to a greater extent than the common supply channel 211 side, so that the second channel member 60 deflects so as to protrude toward the common collecting channel 212 side in the conveyance direction of the recording medium. The higher the heating temperature of the liquid or the higher the flow rate of the liquid flowing into the common collecting channel 212, the higher the temperature of the common collecting channel 212 and thus the larger the deflection amount. Since such deflection becomes larger as the length of the second channel member 60 becomes longer, the deflection may become more noticeable in the so-called page-wide liquid discharge head having a length corresponding to the width of the recording medium 2.

Then, in the present disclosure, the heat unit 250 capable of heating the liquid is arranged upstream of the element substrate 10 in order to suppress the deflection of the second channel member 60 in the conveyance direction of the recording medium 2.

more specifically, as illustrated in FIG. 2, the heat unit 250 is arranged upstream of the common supply channel 211 and between the buffer tank 1003 and the first circulation pump 1001. The examples of heat unit 250 include, for example, a chiller, a heat pump, and a heater, but any other heat unit 250 may also be used as long as the heat unit 250 is capable of heating the liquid.

The heated and warmed liquid flows from the common supply channel 211 through the element substrate 10 and is collected in the common collecting channel 212. Since the liquid, which has already been heated to some extent by the heat unit 250, flows into the element substrate 10, the main heater 5 included in the element substrate 10 can obtain, with a small amount of heat generation, a bubbling pressure necessary for discharging the liquid. That the amount of heat generation from the main heater 5 is small means that the temperature of the liquid in the common collecting channel 212 into which the liquid from the element substrate 10 flows does not rise very much. That the temperature of the liquid in the common collecting channel 212 does not rise very much means that the temperature difference between the temperature of the liquid flowing in the common supply channel 211 and the temperature of the liquid flowing in the common collecting channel 212 can be suppressed from becoming large. Thus, the temperature gradient between the common supply channel 211 and the common collecting channel 212, which causes the channel member 210 to be deformed in the conveyance direction of the recording medium 2, can be suppressed. As a result, deformation of the channel member 210 can be suppressed.

In FIG. 2, an example is described in which the heat unit 250 is arranged upstream of the common supply channel 211 and between the buffer tank 1003 and the second circulation pump 1004, but the present disclosure is not limited thereto. More specifically, as long as the heat unit 250 is arranged upstream of the element substrate 10, the temperature of the liquid flowing into the element substrate 10 can be heated beforehand, and thus the present disclosure allows the heat unit 250 to be arranged at any location upstream of the element substrate 10.

When the common supply channel 211 and the common collecting channel 212 are formed across an interior (inside) and an exterior (outside) of the liquid discharge unit 300 it is more preferable to make, at the outside of the liquid discharge unit 300 (position C illustrated in FIG. 2), the temperature of the liquid flowing through the common supply channel 211 higher than the temperature of the liquid flowing through the common collecting channel 212. Alternatively, it is preferred that the temperature of the liquid flowing into the common supply channel 211 (the temperature of the liquid in the liquid supply unit 220) is higher than the temperature of the liquid flowing into the common collecting channel 212 (the temperature of the liquid in the liquid supply unit 220). In this way, the high-temperature liquid flows into the common supply channel 211 in the liquid discharge unit 300, and thereby the heat amount generated from the main heater 5 necessary for discharging the liquid can be reduced. Further, even if the liquid is heated by main heater 5, the warmed liquid will flow through the common collecting channel 212 having a relatively low temperature. In this way, the difference between the temperature of the liquid flowing in the common supply channel 211 and the temperature of the liquid flowing in the common collecting channel 212 can be made smaller, and thus the deformation of the channel member 210 in the conveyance direction of the recording medium 2 can be further suppressed.

To cause the liquid in the common supply channel 211 and the liquid in the common collecting channel 212 to have different temperatures, two heat units, one for the common supply channel 211 and the other for the common collecting channel 212, may be provided in the recording apparatus 1000. However, in this case, the temperature of the liquid flowing into the common collecting channel 212 and the temperature of the liquid flowing into the common supply channel 211 have to be controlled separately, which may complicate the recording apparatus 1000. Therefore, it is preferable to provide the heat unit 250 at one of the locations communicating with the common supply channel 211 to provide a desired temperature difference between the liquid in the common supply channel 211 and the liquid in the common collecting channel 212.

A second exemplary embodiment will be described. The same signs are given to the same parts as in the first exemplary embodiment, and an explanation thereof will be omitted. In the present exemplary embodiment, while heating, by the heat unit 250, the liquid flowing in the common supply channel 211, the flow rate of the liquid flowing through the common supply channel 211 is made larger than the flow rate of the liquid flowing through the common collecting channel 212. In this way, when the cross-section area of the common supply channel 211 and the cross-section area of the common collecting channel 212 are the same (or substantially the same), the flow speed of the liquid flowing through the common supply channel 211 is greater than the flow speed of the liquid flowing through the common collecting channel 212. Thus, the time required for the liquid, which has flowed into the common supply channel 211, to flow out to the outside (i.e., to the common collecting channel 212 or the liquid supply unit 220 illustrated in FIG. 2) becomes shorter than the time required for the liquid, which has flowed into the common collecting channel 212, to flow out to the outside (i.e., to the liquid supply unit 220). In other words, the time that a certain volume of liquid is staying in the common supply channel 211 is shorter than the time that the liquid is staying in the common collecting channel 212. Thus, when comparing the degrees to which the liquid flowing in respective channels are cooled by the channel member 210, the degree of cooling by the channel member 210 is smaller for the liquid flowing in the common supply channel 211 than for the liquid flowing in the common collecting channel 212. Thus, the temperature decrease can be suppressed for the liquid in the common supply channel 211, and the temperature of the liquid in the common collecting channel 212 can decrease. Suppressing the decrease in the temperature of the liquid in the common supply channel 211 can reduce the heat amount required for discharging the liquid and generated from the main heater 5. In addition, lowering the temperature of the liquid in the common collecting channel 212 causes, even if the liquid is heated by the main heater 5, the warmed liquid to flow through the common collecting channel 212 having a relatively low temperature. As a result, the difference between the temperature of the liquid flowing in the common supply channel 211 and the temperature of the liquid flowing in the common collecting channel 212 can be made smaller, thus making it possible to further suppress the deformation of the channel member 210 in the conveyance direction of the recording medium 2.

As a unit for making the temperature of the liquid flowing in the common supply channel 211 at the position C illustrated in FIG. 2 higher than the temperature of the liquid flowing in the common collecting channel 212 at the position C, the following method can be employed, for example. For example, by making the cross-section area of the common supply channel 211 smaller than the cross-section area of the common collecting channel 212, the time of the liquid flowing through each of the channels is adjusted. In this way, the liquid temperature of the common supply channel 211 becomes larger than the liquid temperature of the common collecting channel 212. In this case, the cross-section area of the channel is the average value of the cross-section areas at 10 randomly selected locations.

Alternatively, it may be configured in such a manner that the thickness of the member around the common supply channel 211 of the channel member 210 is made thick and the thickness of the member around the common collecting channel 212 of the channel member 210 is made thin, so that the degree to which the liquid is cooled in the common supply channel 211 is relatively low compared with that in the common collecting channel 212. In this case, the thickness of the member refers to the thickness from the channel to the outer wall in the second channel member 60. Alternatively, properly adjusting the material of the channel member 210 can make the insulation ratio around the common supply channel 211 greater than the insulation ratio around the common collecting channel 212. In other words, the insulation ratio of the path from the heat unit 250 to the common supply channel 211 is greater than the insulation ratio of the path from the heat unit 250 to the common collecting channel 212. This configuration also enables the temperature of the liquid in the common supply channel 211 to be higher than the temperature of the liquid in the common collecting channel 212. Another method is to make the channel length of the common supply channel 211 shorter than the channel length of the common collecting channel 212.

Figure 8:
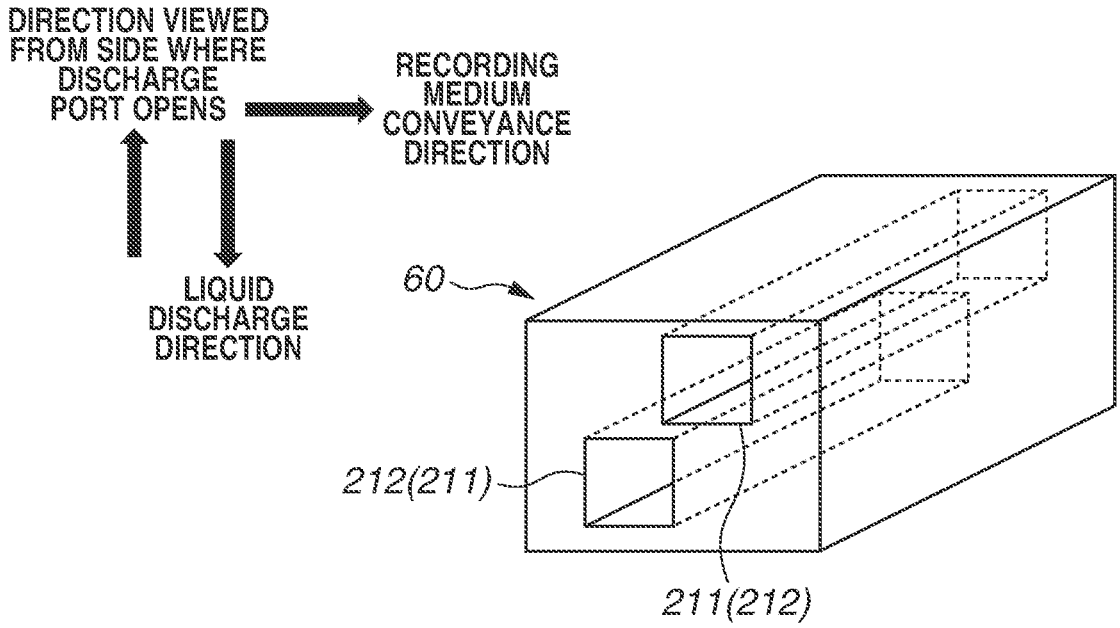
FIG. 8 is a perspective view of the channel member illustrated in FIG. 7A.

A third exemplary embodiment will be described with reference to FIGS. 7A to 7E and FIG. 8. The same signs are given to the same parts as in the first exemplary embodiment, and an explanation thereof will be omitted. FIGS. 7A to 7E are schematic views each illustrating a cross-section of the second channel member 60 according to the present exemplary embodiment. FIG. 8 is a perspective view of the second channel member 60 illustrated in FIG. 7A. FIGS. 7A to 7E and 8 are simplified for illustration.

In the present exemplary embodiment, as in the previous exemplary embodiments, the liquid flowing through the common supply channel 211 is heated by the heat unit 250. Then, the common supply channel 211 and the common collecting channel 212 are arranged so that, when viewed from the side where the discharge port 13 opens, at least a part of the common supply channel 211 and at least a part of the common collecting channel 212 overlap each other. Such a configuration can further suppress the deflection of the second channel member 60 in the conveyance direction of the recording medium 2. The view from the side where the discharge port 13 opens is the view through the internal structure of the head such as the common supply channel 211 and common collecting channel 212 of the second channel member 60. Arranging the common supply channel 211 and the common collecting channel 212 so that at least a part of the common supply channel 211 and at least a part of the common collecting channel 212 overlap each other causes the above-described temperature gradient in a direction intersecting the conveyance direction of the recording medium 2. This can suppress the temperature gradient from being caused in the conveyance direction of the recording medium 2, thus making it possible to further suppress the deformation of the second channel member 60 in the conveyance direction of the recording medium 2.

In addition, making the configuration of the present exemplary embodiment as described above causes a temperature gradient in the discharge direction of the liquid in the second channel member 60. This may cause the second channel member 60 to deflect in the discharge direction of the liquid. However, when the second channel member 60 deflects in the discharge direction of the liquid, the head-to-paper distance varies affected by the discharge port 13, but the position of the discharge port 13 in the conveyance direction of the recording medium 2 is suppressed from varying, so that the effect on a recording quality is small.

According to the present disclosure, it is possible to provide the recording apparatus capable of suppressing deformation of the channel member in the conveyance direction of the recording medium.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-196421, filed Nov. 26, 2020, which is hereby incorporated by reference herein in its entirety.

What is claimed is:

1. A recording apparatus that performs recording on a recording medium, the recording apparatus comprising:

a liquid discharge head including a plurality of element substrates each having a discharge port configured to discharge liquid and a heat element configured to heat the liquid, a channel member including a common supply channel configured to communicate with the plurality of the element substrates and to supply the liquid to the plurality of the element substrates, and a common collecting channel configured to communicate with the plurality of the element substrates and to collect the liquid from the plurality of the element substrates, wherein the common supply channel and the common collecting channel are respectively disposed out of alignment in a conveyance direction of the recording medium, and wherein, upstream of the element substrates, the recording apparatus comprises a heat unit configured to heat the liquid flowing in the common supply channel.

2. The recording apparatus according to claim 1, wherein the heat unit is arranged upstream of all of the plurality of the element substrates.

3. The recording apparatus according to claim 1, wherein the heat unit is arranged outside the liquid discharge head.

4. The recording apparatus according to claim 1, further comprising a buffer tank configured to store the liquid to be supplied to the liquid discharge head, wherein the heat unit is arranged between the buffer tank and the liquid discharge head.

5. The recording apparatus according to claim 1, wherein the liquid collected by the common collecting channel circulates to outside of the element substrates and flows into the common supply channel.

6. The recording apparatus according to claim 1, wherein a temperature of the liquid flowing into the common supply channel is higher than a temperature of the liquid flowing into the common collecting channel.

7. The recording apparatus according to claim 1, wherein a flow rate of the liquid flowing through an inlet port of the common supply channel is greater than a flow rate of the liquid flowing through an inlet port of the common collecting channel.

8. The recording apparatus according to claim 1, wherein, when viewed from a side where the discharge port opens, at least a part of the common supply channel and at least a part of the common collecting channel overlap each other.

9. The recording apparatus according to claim 1, wherein a cross-section area of the common supply channel is smaller than a cross-section area of the common collecting channel.

10. The recording apparatus according to claim 1, wherein a length of the common supply channel is shorter than a length of the common collecting channel.

11. The recording apparatus according to claim 1, wherein a heat insulation ratio of a path from the heat unit to the common supply channel is greater than a heat insulation ratio of a path from the heat unit to the common collecting channel.

12. The recording apparatus according to claim 1, wherein the heat unit is a chiller.

13. The recording apparatus according to claim 1, wherein the heat element is a pressure generation element configured to heat the liquid to generate a pressure for discharging the liquid from the discharge port.

14. The recording apparatus according to claim 1, wherein the heat element is a sub-heater configured to heat the liquid and is different from a pressure generation element configured to heat the liquid to generate a pressure for discharging the liquid from the discharge port.

15. The recording apparatus according to claim 1, wherein the heat element includes a pressure generation element configured to heat the liquid to generate a pressure for discharging the liquid from the discharge port, and a sub-heater, different from the pressure generation element, configured to heat the liquid.

16. The recording apparatus according to claim 1, wherein the liquid discharge head is of a page-wide type in which a plurality of the discharge ports is arranged from one end of the recording medium to another end of the recording medium in a direction intersecting the conveyance direction of the recording medium.

* * * * *